US009869323B2

(12) United States Patent
Ravier

(10) Patent No.: US 9,869,323 B2
(45) Date of Patent: Jan. 16, 2018

(54) LINEAR GASKET FOR AN INTER-BLADE PLATFORM

(71) Applicant: SNECMA, Paris (FR)

(72) Inventor: Anne-Laure Ravier, Nogent sur Marne (FR)

(73) Assignee: SNECMA, Paris (FR)

( * ) Notice: Subject to any disclaimer, the term of this patent is extended or adjusted under 35 U.S.C. 154(b) by 364 days.

(21) Appl. No.: 14/378,788

(22) PCT Filed: Feb. 15, 2013

(86) PCT No.: PCT/FR2013/050310

§ 371 (c)(1),
(2) Date: Aug. 14, 2014

(87) PCT Pub. No.: WO2013/124570

PCT Pub. Date: Aug. 29, 2013

(65) Prior Publication Data

US 2015/0016960 A1 Jan. 15, 2015

(30) Foreign Application Priority Data

Feb. 22, 2012 (FR) ..... 12 51611

(51) Int. Cl.
*F01D 5/30* (2006.01)
*F04D 29/16* (2006.01)
*F01D 11/00* (2006.01)

(52) U.S. Cl.
CPC ..... *F04D 29/16* (2013.01); *F01D 11/008* (2013.01)

(58) Field of Classification Search
CPC ..... F01D 5/066; F01D 5/143; F01D 2240/80; F05D 2240/55; F05D 2220/32
USPC ..... 416/139 A
See application file for complete search history.

(56) References Cited

U.S. PATENT DOCUMENTS 5,615,894 A * 4/1997 vom Schemm ..... B29C 59/02 277/559
5,890,874 A 4/1999 Lambert et al.
6,447,250 B1 9/2002 Corrigan et al.
6,514,045 B1 * 2/2003 Barton ..... F01D 5/22 416/193 A (Continued)

FOREIGN PATENT DOCUMENTS

EP 0 787 890 8/1997
EP 1 865 154 12/2007
EP 2 267 277 12/2010

OTHER PUBLICATIONS

International Search Report dated Apr. 15, 2013, 2013 in PCT/FR13/050310 filed Feb. 15, 2013.

*Primary Examiner* — Craig Kim
*Assistant Examiner* — Jason Mikus
(74) *Attorney, Agent, or Firm* — Oblon, McClelland, Maier & Neustadt, L.L.P.

(57) ABSTRACT

A linear gasket for an inter-blade platform that presents a length, the gasket including a linear base for fastening to the inter-blade platform and a linear lip projecting from the linear base, the linear lip including a linear distal end portion configured to contact a pressure side wall or a suction side wall of a blade, a linear groove being formed between the linear base and the linear lip over at least a fraction of a length of the linear gasket. The linear distal end portion includes at least one linear slit extending over at least a fraction of the length of the gasket.

15 Claims, 3 Drawing Sheets

(56) References Cited

U.S. PATENT DOCUMENTS

| | | | | |
|---|---|---|---|---|
| 6,705,617 | B2 * | 3/2004 | Mellet | F16J 15/3228 277/559 |
| 7,891,670 | B2 * | 2/2011 | Alajbegovic | F16J 15/3244 277/549 |
| 2007/0280830 | A1 * | 12/2007 | Mulcaire | F01D 11/008 416/193 R |
| 2010/0150724 | A1 | 6/2010 | Forgue et al. | |
| 2010/0322772 | A1 | 12/2010 | Hoyland et al. | |

* cited by examiner

LINEAR GASKET FOR AN INTER-BLADE PLATFORM

FIELD OF THE INVENTION

The invention relates to a linear gasket for an inter-blade platform. Such a linear gasket is arranged between a blade and a platform between blades and that is distinct from the blades, and it serves to limit the flow of air between the blade and the inter-blade platform. Such a blade is used particularly, but not exclusively, in fans, between the blades of the fan and the inter-blade platforms.

PRIOR ART

An inter-blade platform linear gasket is known that presents a length, the gasket comprising a linear base for fastening to the inter-blade platform and a linear lip projecting from the linear base, said linear lip presenting a linear distal end portion configured to contact a pressure side wall or a suction side wall of a blade, a linear groove being formed between the linear base and the linear lip over at least a fraction of the length of said linear gasket. That type of gasket extends along the pressure side or the suction side of a blade, including its leading edge and/or trailing edge.

The lip of that type of prior art gasket does not make it possible to fit closely to the blade in zones of sudden discontinuity or of small radius of curvature, such as for example in the vicinity of the leading edge or the trailing edge of the blade. As a result, air flows between the blade and the inter-blade platform in those zones. The sealing of the air (or gas) passage is thus not perfect, thereby degrading the performance of the gas turbine reaction engine.

SUMMARY OF THE INVENTION

The object of the present invention is to remedy the above-mentioned drawback, at least substantially.

The invention achieves this object by proposing a linear gasket of the above-specified type, wherein at least one linear slit extending over at least a fraction of the length of said gasket.

Below, the terms "gasket", "base", "lip", "groove", "slit", and "distal end portion" may be used instead of "linear gasket", "linear base", "linear lip", "linear groove", "linear slit", and "linear distal end portion", in order to designate the same entities. Likewise, the term "platform" may be used instead of "inter-blade platform" to designate the same entity.

It can be understood that the linear gasket extends in a preferred direction, the longitudinal direction. This longitudinal direction is not necessarily rectilinear, and is preferably configured to follow the outlines of the blade, in particular in the vicinity of discontinuities of the blade. In other words, it can be considered that the length direction follows the neutral axis of the gasket. The length of the gasket is thus defined and measured parallel to this longitudinal direction. Likewise, the linear lip, the linear base, and the linear groove all extend along this longitudinal direction. The length of the lip, the length of the base, and the length of the groove are defined and measured likewise parallel to this longitudinal direction. It can be understood that the lip projects widthwise in a direction that is transverse relative to the longitudinal direction from the base. The groove is defined between the base and the lip in the portions of the gasket where the base and the lip form an angle of less than 90° (ninety degrees of angle), the angle being measured in a cross-section relative to the longitudinal direction. The linear distal end portion is a portion that extends lengthwise in the longitudinal direction, and widthwise over a distance of about 20% of the width of the lip. It can thus be understood that the linear distal end portion is arranged remote from the junction zone between the lip and the base. At least one linear slit is arranged in the linear distal end portion and extends in the longitudinal direction.

Because of the linear slit, the distal end portion is locally more flexible than the same distal end portion would be if it did not have such a slit. In comparison with gaskets of the prior art, the slit thus enables the lip to fit more closely to the outline of the blade, in particular in zones of the blade having a sudden discontinuity or a small radius of curvature. Furthermore, since the gasket is locally more flexible because of the slit, it adapts to the shape of the blade while being subjected to smaller mechanical stresses and wear than those to which prior art gaskets are subjected, thereby improving the lifetime of the gasket of the invention compared with prior art gaskets.

Preferably, the at least one linear slit is formed in a lip segment configured to contact the blade in the vicinity of a leading edge of the blade and/or in the vicinity of a trailing edge of the blade.

It can be understood that a lip segment is a portion of the lip considered in the longitudinal direction. The leading edge and the trailing edge of a blade are the regions that present the most sudden discontinuities. By placing a slit in the lip segments that are configured to come into contact with the blade in the vicinity of the leading edge and of the trailing edge, it is ensured that the gasket will fit as closely as possible to the wall of the blade, including in the vicinity of the leading edge and of the trailing edge.

Advantageously, the linear slit extends over the entire length of the linear lip.

In this configuration, it is ensured that the distal end portion presents local flexibility enabling the lip to match the shape of the contact surface of the blade all along its length. This provides the gasket with better ability to achieve leaktight contact with the wall of the blade.

Advantageously, the inter-blade linear gasket presents a cross-section that varies along the length of the gasket.

It can be understood that the shape of the cross-section of the linear gasket (i.e. its section on a plane perpendicular to the longitudinal direction of the gasket) varies in the longitudinal direction of the gasket. By having such a varying section, the gasket is adapted to fit as closely as possible to the blade depending on the shape of the blade.

In an embodiment, the cross-section of the platform varies and/or the cross-section of the lip varies.

Advantageously, the base presents a shoulder configured to co-operate with an edge of the inter-blade platform.

The linear gasket is generally arranged along an edge of a platform, said edge being for facing the pressure side or the suction side of the blade. Such a shoulder enables the gasket to be properly positioned relative to the platform while the gasket is being assembled on the platform. By means of such a shoulder, the gasket thus presents a protective portion covering said edge of the platform. Such a protective portion serves in particular to damp any impacts between the blade and the platform (or between facing portions of two adjacent platforms), should they come into contact.

Advantageously, inter-blade linear gasket includes at least one lip stiffener.

Such a stiffener serves to make the entire lip stiffer over a segment of the lip, the lip thus being pressed better against the wall of the blade. Thus, by means of the stiffener, the lip is pressed against the wall of the blade, whereas by means of the slit, the distal end of the lip is a close fit to the shape of the wall of the blade and provides leaktight contact.

The invention also provides an inter-blade platform including an inter-blade platform linear gasket of the invention.

The invention also provides a rotor comprising a disk having, mounted at its periphery, a plurality of blades and a plurality of inter-blade platforms, an inter-blade platform being arranged between each pair of adjacent blades, at least one of the inter-blade platforms including at least one inter-blade platform linear gasket of the invention.

Advantageously, the lip of said linear gasket is configured to co-operate with a blade root under a leading edge of said blade, in the vicinity of said leading edge.

In a height direction, a blade presents, in succession, a root followed by an airfoil, the root being the portion whereby the blade is fastened to the disk. The airfoil is the portion of the blade that interacts with air, this airfoil having a leading edge, a trailing edge, a pressure side, and a suction side. The root presents an intermediate portion that does not engage the disk. It can be understood that the gasket co-operates with the blade in this intermediate portion. The term "beneath" relates to the height direction of the blade, the blade root defining the bottom of the blade and the airfoil defining the top of the blade. Thus, by stating that the gasket is placed beneath the leading edge, it should be understood that the gasket is placed in the height direction towards the bottom of the blade relative to the transition zone between the root and the airfoil of the blade, in register with the leading edge. The term "in the vicinity" means that the gasket is arranged in the height direction in a zone extending over about 10% of the total height of the blade beneath the leading edge, and in the longitudinal direction in a zone centered on the leading edge and extending over about 20% of the length of the blade.

Advantageously, each of at least two inter-blade platforms has at least one inter-blade platform linear gasket of the invention, the at least two inter-blade platforms being adjacent to a common blade, said at least one linear gasket of an inter-blade platform from the at least two inter-blade platforms being arranged facing said at least one linear gasket of the other inter-blade platform from the at least two inter-blade platforms upstream from a leading edge and/or downstream from a trailing edge of each blade, said linear gaskets co-operating by pressing against each other upstream from the leading edge and/or downstream from the trailing edge of said blade.

The terms "upstream" and "downstream" refer to the flow direction of air (or gas) along the blade, the air flowing generally from the leading edge towards the trailing edge. It can be understood that each of two adjacent platforms on either side of a blade has a respective gasket of the invention on its edge facing said blade. These gaskets extend beyond the leading edge and beyond the trailing edge of the blade (i.e. the gaskets are longer than the blade), and they co-operate directly with each other by pressing against each other in these zones beyond the leading and trailing edges. The invention also provides a gas turbine reaction engine including a rotor of the invention.

BRIEF DESCRIPTION OF THE DRAWINGS

The invention and its advantages can better understood on reading the following detailed description of embodiments of the invention given as non-limiting examples. The description refers to the accompanying drawing sheets, in which.

DETAILED DESCRIPTION OF EMBODIMENTS

Figure 1:
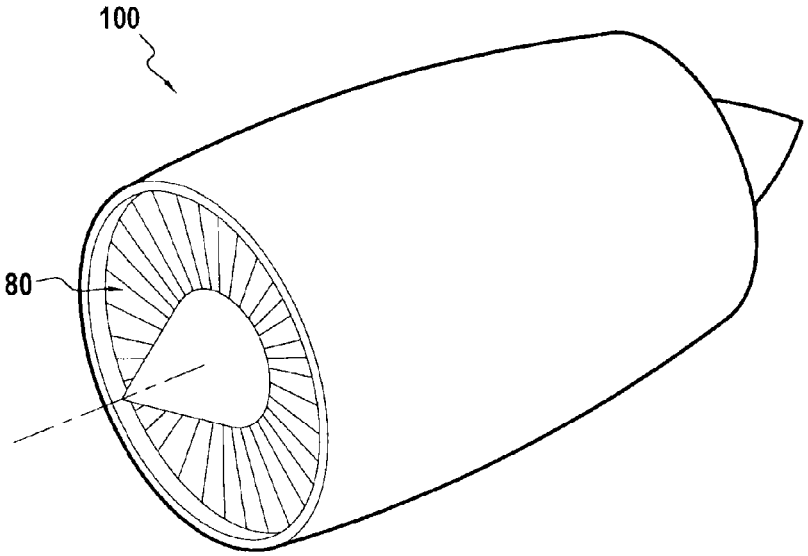
FIG. 1 shows a gas turbine reaction engine of the invention.
Figure 2:
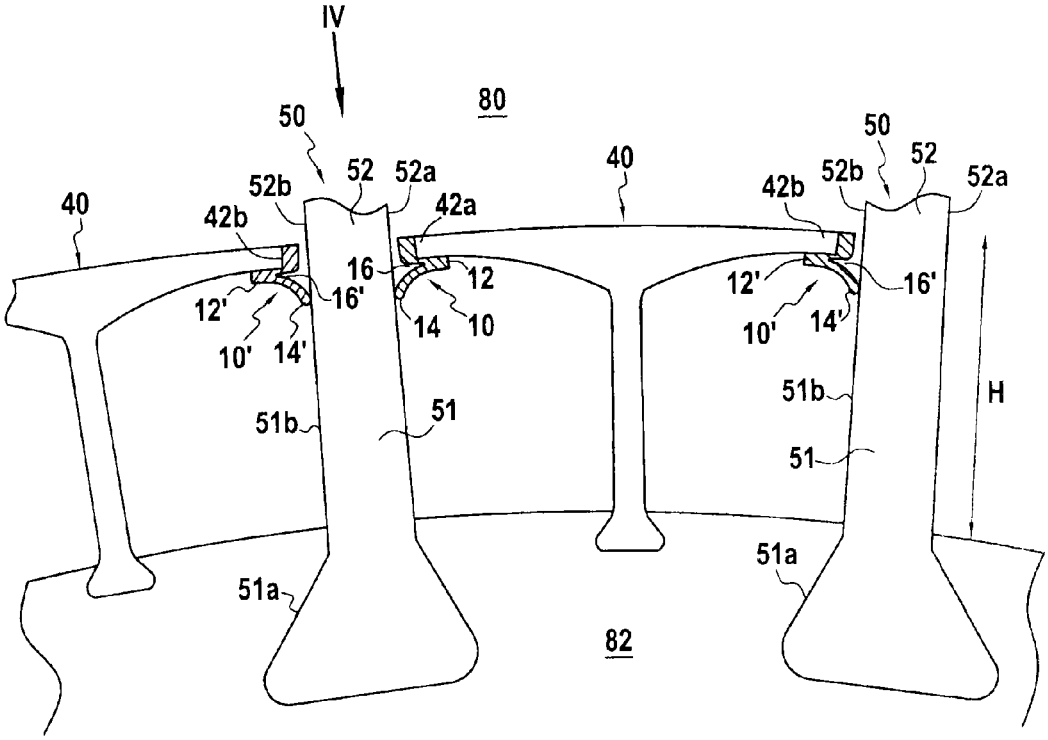
FIG. 2 is a fragmentary view of a section of the fan of the FIG. 1 gas turbine reaction engine.

FIG. 1 shows a gas turbine reaction engine 100 including fan 80 forming a rotor of the invention. As shown in FIG. 2, the fan 80 comprises a disk 82 having mounted at its periphery both a plurality of blades 50 and a plurality of inter-blade platforms 40, each blade 50 being interposed between two inter-blade platforms 40. In other words, each platform 40 is arranged between a pair of adjacent blades 50. In this example, each edge 42*a* and 42*b* of each platform 40, facing the pressure side 52*a* and the suction side 52*b* of respective blades 50, is provided with a respective linear gasket 10 or 10' of the invention. Each linear gasket 10 and 10' presents a respective linear base 12, 12' and a linear lip 14, 14', a respective linear groove 16, 16' being formed between the base 12 and the lip 14 or between the base 12' and the lip 14'. In this example, the gasket 10 is configured to co-operate with the blade 50 on its pressure side 52*a*, while the gasket 10' is configured to co-operate with the blade 50 on its suction side 52*b*. Each blade 50 presents in succession along its height H, a root 51 followed by an airfoil 52. The root 51 presents a portion 51*a* engaged in the disk 82 and an intermediate portion 51*b*. The airfoil 52 presents the pressure side 52*a*, the suction side 52*b*, a leading edge 52*c*, and a trailing edge 52*d* (cf. FIG. 4).

In general, the pressure side wall and the suction side wall are substantially continuous (i.e. they do not show any significant differences) between the intermediate portion 51*b* of the root 51 and the airfoil 52, such that the pressure side wall and the suction side wall of the blade at the root of the blade are sometimes also referred to as the pressure side and the suction side.

Figure 3:
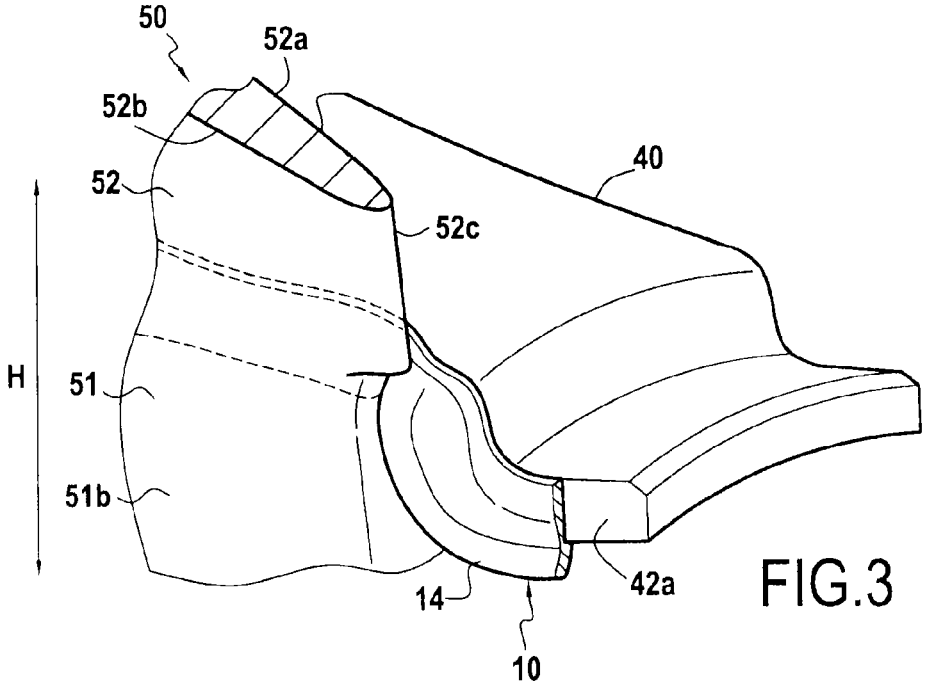
FIG. 3 is a fragmentary view in perspective of the gasket of the invention within the fan of the gas turbine reaction engine of the invention.

As shown in FIG. 3, the lip 14 of the gasket 10 co-operates with the root 51 of the blade 50 beneath the leading edge 52*c* of the blade 50 in the vicinity of said leading edge 52*c*. Although not shown, the gasket 10' co-operates likewise with the root 51 of the blade 50, beneath the leading edge 52*c* of the blade 50, in the vicinity of said leading edge 52*c*. It should be observed that FIG. 3 is a fragmentary view that shows only a portion of the blade 50 (a portion of the intermediate portion 51*a* and a portion of the airfoil 52), together with a portion of the platform 40 and a portion of the gasket 10.

Figure 4:
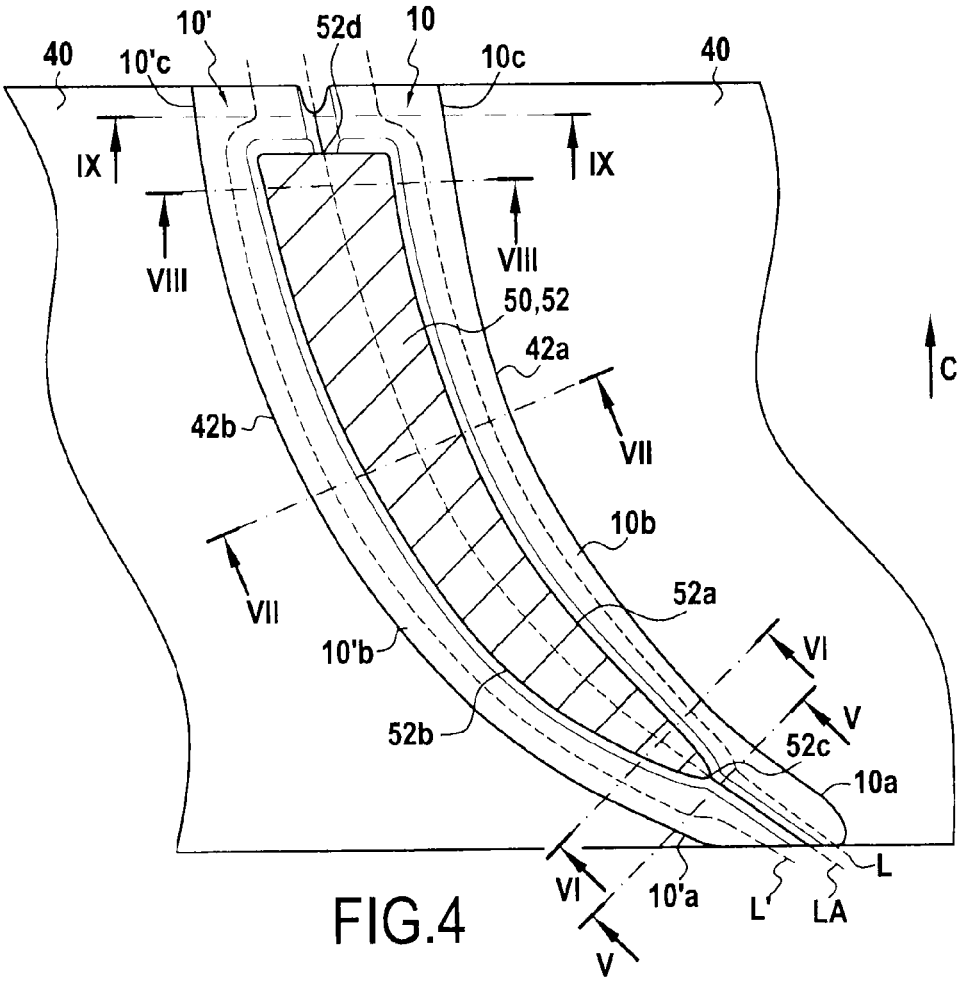
FIG. 4 shows the FIG. 2 fan seen looking along arrow IV.

FIG. 4 is a view of a blade 50 together with two platforms 40 seen looking along arrow IV of FIG. 2. The gaskets 10 and 10' extend from upstream of the leading edge 52*c* of the blade 50 to downstream of the trailing edge 52*d* of the blade 50. Thus, each gasket 10 and 10' presents a segment 10*a*, 10'*a* that extends upstream from the leading edge 52*c*, a segment 10*b*, 10'*b* that extends facing the pressure side 52*a* or the suction side 52*b* respectively of the blade 50, and a segment 10*c*, 10'*c* that extends downstream from the trailing edge 52*d* of the blade 50. "Upstream" and "downstream" are considered relative to the flow of air as represented by arrow C flowing along the blade 50, with the arrow C pointing from upstream to downstream. Each gasket segment extends over a longitudinal portion of the gasket. The longitudinal directions of the gaskets 10 and 10' are represented by respective dashed lines L and L'. The upstream segments 10*a* and 10'*a* face each other such that the lips 14 and 14' of the gaskets 10 and 10' co-operate by bearing against each other in the zone upstream from the blade 50 (cf. FIG. 5). Likewise, the downstream segments 10*c* and 10'*c* face each other so that the lips 14 and 14'*c* of the gaskets 10 and 10' co-operate by pressing against each other in the zone downstream from the blade 50 (cf. FIG. 9).

In the zones that are configured to come into contact with the vicinity of the leading edge 52*c* and of the trailing edge 52*d*, the gaskets 10 and 10' present linear slits 120 & 122 and 120' & 122' (cf. FIGS. 5, 6, 8, and 9). These slits 120, 122 and 120', 122' extend respectively along directions that are substantially parallel to the longitudinal directions L and L'. It should be observed that along the outline of the blade 50, the longitudinal directions L and L' are substantially parallel to the walls of the blade 50.

Figure 5:
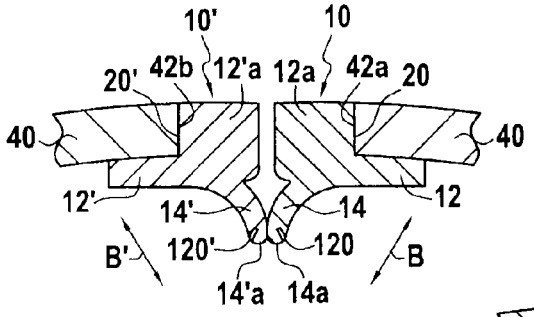
FIG. 5 shows the linear gaskets of FIG. 4 on section V.
Figure 6:
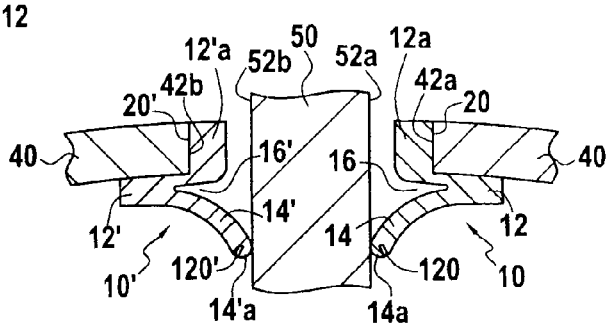
FIG. 6 shows the linear gaskets of FIG. 4 on section VI.
Figure 7:
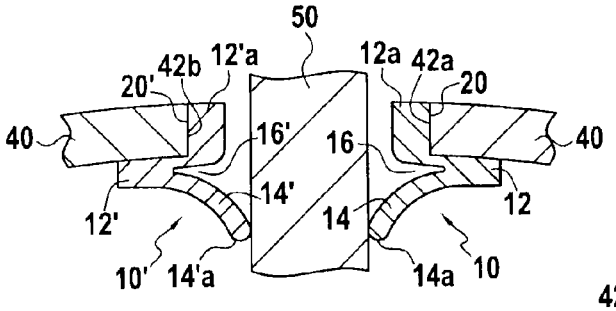
FIG. 7 shows the linear gaskets of FIG. 4 on section VII.
Figure 8:
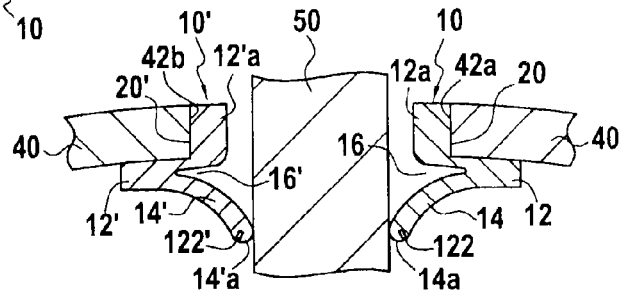
FIG. 8 shows the linear gaskets of FIG. 4 on section VIII.
Figure 9:
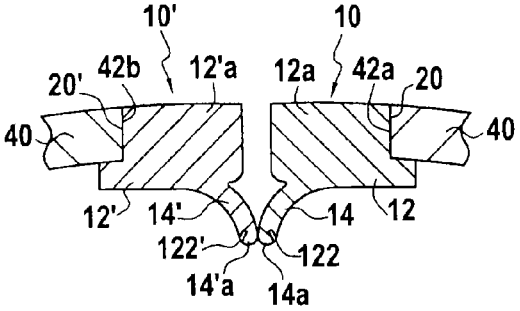
FIG. 9 shows the linear gaskets of FIG. 4 on section IX.

As shown in FIGS. 5 and 6, the linear distal end portions 14*a* and 14'*a* have respective linear slits 120 and 120'. Each of these FIGS. 5 and 6 shows a section of the assembly comprising a blade and platforms as shown in FIG. 4 in the vicinity of the leading edge 52*c* of the blade 50. Directions B and B' that are respectively substantially parallel to the lips 14 and 14', indicate the respective width directions of the lips 14 and 14'. The "distal" nature of the distal end portion is considered along these directions B and B', the distal end portion of a lip being remote from its base along the width direction of the lip. FIG. 7 is a section through the assembly of a blade and platforms as shown in FIG. 4 in a zone that is distinct from being in the vicinity of the leading edge 52*c* or of the trailing edge 52*d* of the blade 50. In this zone that is distinct from the vicinity of the leading edge 52*c* and of the trailing edge 52*d*, the gaskets 10 and 10' do not present any linear slit. In the same manner as in the vicinity of the leading edge 52*c*, the gaskets 10 and 10' present respective slits 122 and 122' in the vicinity of the trailing edge 52*d* in the distal end portion 14*a* of the lip 14 and in the distal end portion 14'*a* of the lip 14', as shown in FIGS. 8 and 9.

The cross-section of the gaskets 10 and 10', and more particularly of the base 12 and of the lip 14 of the gasket 10 and of the base 12' and of the lip 14' of the gasket 10', varies along the longitudinal direction L or L', as can be seen in FIGS. 5 to 9.

Figure 10:
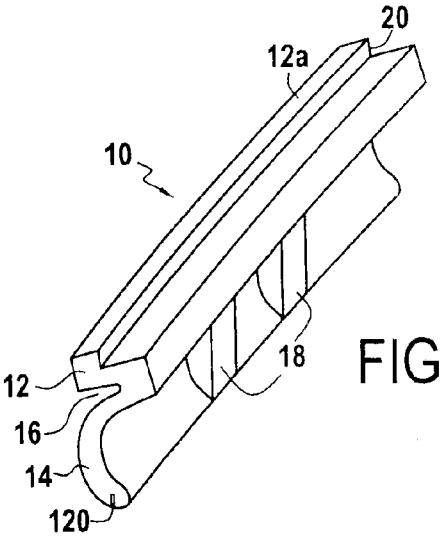
FIG. 10 shows a segment of the linear gasket of the invention in a perspective view.

FIG. 10 shows a segment of gasket 10 including stiffeners 18. In this example, each stiffener 18 is in the form of a rib formed integrally with the gasket 10. In a variant, a stiffener is formed by reinforcement arranged in the thickness of the lip, or indeed by a sheath arranged around the lip. Such stiffeners may also be provided for the gasket 10'.

The gaskets 10 and 10' present respective shoulders 20 and 20' arranged in the thickness of the base 12 or 12'. Thus, each of the bases 12 and 12' presents a protective portion 12*a* or 12'*a* respectively covering the edge 42*a* or 42*b* of a platform 40. As shown in FIGS. 4 to 9, the protective portions 12*a* and 12'*a* are thicker in the segments 10*a*, 10'*a* and 10*c*, 10'*c* (i.e. upstream from the leading edge and downstream from the trailing edge) than in the segments 10*b* and 10'*b*. These greater thicknesses in these zones serve in particular to stiffen the gaskets 10 and 10' in the zones and prevent the lips from folding outwards (i.e. occupying positions beside the airfoil 52 of the blade).

The gaskets 10 and 10' are preferably made of plastic elastomer and they are fabricated by molding.

Although the present invention is described with reference to specific embodiments, it is clear that modifications and changes may be made to those embodiments without going beyond the general ambit of the invention as defined by the claims. In particular, individual characteristics of the various embodiments shown and/or mentioned may be combined in additional embodiments. Consequently, the description and the drawings could be considered in an illustrative sense rather than a restricted sense.

The invention claimed is:

1. A linear gasket, the gasket being configured for an inter-blade platform that presents a length, and the gasket comprising:

a linear base to fasten to the inter-blade platform and a linear lip projecting from the linear base, the linear lip including a linear distal end portion configured to contact a pressure side wall or a suction side wall of a blade, a linear groove being formed between the linear base and the linear lip over at least a fraction of a length of the gasket, and the linear distal end portion including at least one linear slit extending over at least a fraction of the length of the gasket, and the at least one linear slit extending substantially parallel to a leading to trailing edge extension direction of the pressure side wall or the suction side wall of the blade when the linear distal end portion is in contact with the pressure side wall or the suction side wall of the blade.

2. An inter-blade platform linear gasket according to claim 1, wherein the at least one linear slit is formed in a lip segment, said lip segment configured to contact the blade in a vicinity of a leading edge of the blade and/or in a vicinity of a trailing edge of the blade.

3. An inter-blade platform linear gasket according to claim 1, wherein the linear slit extends over an entire length of the linear lip.

4. An inter-blade platform linear gasket according to claim 1, presenting a cross-section that varies along the length of the gasket.

5. An inter-blade platform linear gasket according to claim 1, including at least one stiffener of the lip.

6. An inter-blade platform including an inter-blade platform linear gasket according to claim 1.

7. A rotor comprising:

a disk including, mounted at its periphery, a plurality of blades and a plurality of inter-blade platforms, an inter-blade platform being arranged between each pair of adjacent blades, at least one of the inter-blade platforms including at least one inter-blade platform linear gasket according to claim 1.

8. A rotor according to claim 7, wherein the lip of the linear gasket is configured to co-operate with a blade root under a leading edge of the blade, in a vicinity of the leading edge.

9. A rotor according to claim 7, including at least two inter-blade platforms, each including the at least one inter-blade platform linear gasket, the at least two inter-blade platforms being adjacent to a common blade, the at least one linear gasket of an inter-blade platform from the at least two inter-blade platforms being arranged facing the at least one linear gasket of the other inter-blade platform from the at least two inter-blade platforms upstream from a leading edge and/or downstream from a trailing edge of said blade, the linear gaskets co-operating by pressing against each other upstream from the leading edge and/or downstream from the trailing edge of the blade.

10. A gas turbine reaction engine comprising a rotor according to claim 7.

11. An inter-blade platform linear gasket according to claim 2, wherein the linear distal end portion does not include any linear slit in a zone that is distinct from being in the vicinity of the leading edge of the blade and the vicinity of the trailing edge of the blade.

12. An inter-blade platform linear gasket according to claim 1, wherein the linear base includes a protective portion that covers an edge of the inter-blade platform, and the protective portion is thicker in a segment of the gasket that is upstream from a leading edge of the blade or downstream from a trailing edge of the blade than in a segment of the gasket that is between the leading edge of the blade and the trailing edge of the blade.

13. An inter-blade platform linear gasket according to claim 1, wherein an outer surface of the linear lip relative to the blade includes the at least one linear slit, and an inner surface of the linear lip does not include any linear slit.

14. An inter-blade platform linear gasket according to claim 1, wherein the at least one linear slit provides flexibility to the linear distal end portion to adapt to a shape of the blade along the leading to trailing edge extension direction of the pressure side wall or the suction side wall of the blade.

15. An inter-blade platform linear gasket according to claim 1, wherein a first side surface of the linear distal end portion is configured to contact the pressure side wall or the suction side wall of the blade, and a second side surface of the linear distal end portion that is opposite the first side surface includes the at least one linear slit.

* * * * *